US005685042A

United States Patent [19]

Demetriades

[11] Patent Number: 5,685,042

[45] Date of Patent: Nov. 11, 1997

[54] FLOOR PAD

[76] Inventor: Peter G. Demetriades, 2118 Coleman Pl., Henderson, N.C. 27536

[21] Appl. No.: 562,172

[22] Filed: Nov. 22, 1995

[51] Int. Cl.[6] ..... A47L 13/16; B24B 29/00

[52] U.S. Cl. ..... 15/230.12; 15/230; 15/230.16; 451/526

[58] Field of Search ..... 15/230, 230.12, 15/230.13, 230.14, 230.15, 230.16, 230.17, 230.18, 230.19, 210.1, 209.1, 208, 98; 451/111, 259, 532, 526, 527, 458, 536, 538

[56] References Cited

U.S. PATENT DOCUMENTS

| | | | |
|---|---|---|---|
| 4,502,174 | 3/1985 | Rones | 15/230 |
| 4,536,911 | 8/1985 | Demetriades | 451/526 |

FOREIGN PATENT DOCUMENTS

| | | | |
|---|---|---|---|
| 756974 | 10/1933 | France | 15/230.19 |
| 2906549 | 8/1979 | Germany | 15/230 |

*Primary Examiner*—Gary K. Graham
*Attorney, Agent, or Firm*—Lalos & Keegan

[57] ABSTRACT

A pad mountable either on an end or side portion of a drive shaft of a floor working machine with at least one stratum of a porous, non-woven, air-layered fibrous material secured together with an adhesive binder. The stratum having a first opening for receiving a fastener and at least one set of a plurality of circumferentially spaced, arcuate weakened segments, disposed concentrically relative to the first opening providing a plurality of unweakened segments disposed between the weakened segments, whereby the pad selectively may be mounted on an end portion of a drive shaft of a machine of a fastening device being inserted through the first opening. The pad alternatively may be mounted on the side portion of a drive shaft by severing the pad along the weakened and unweakened segments to provide an opening for receiving the drive shaft therethrough and securing the pad thereto.

12 Claims, 1 Drawing Sheet

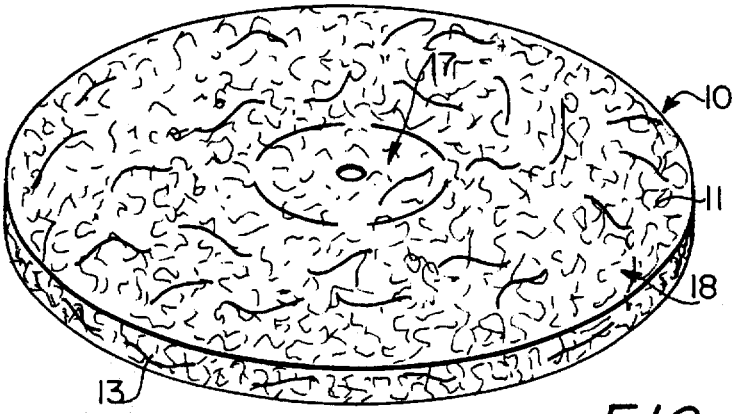
FIG. 1
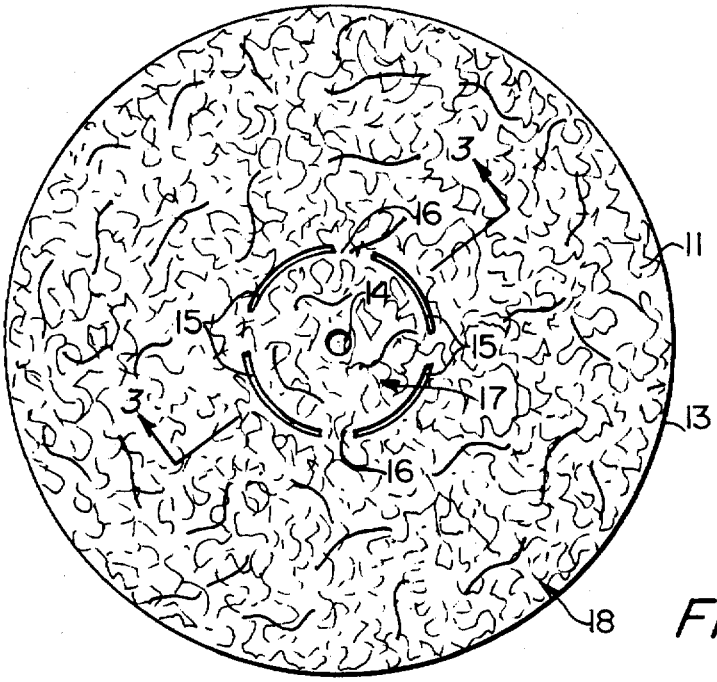
FIG. 2
FIG. 3
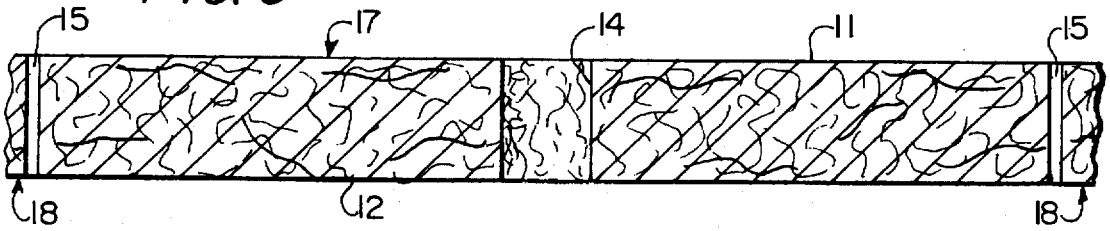

FLOOR PAD

BACKGROUND OF THE INVENTION

This invention relates to a floor pad adapted to be installed on machines for stripping or burnishing hard floor surfaces and more particularly to such a floor pad which is adapted for use in such machines having different pad installation arrangements.

In the janitorial trade, there commonly is used a type of machine for stripping and burnishing hard floor surfaces which generally consist of a deck assembly, a floor engaging pad installed on the underside of the deck assembly and an upright handle used by the operator to guide the deck assembly over a floor area to be stripped or burnished. Such deck assemblies typically include a housing and an electric or gas direct drive motor mounted on the housing and having a depending shaft on which a replaceable pad may be mounted. In more recently developed machines of such type, the motors are designed to operate at speeds of up to 3,000 rpm. The floor pads used with such machines typically consist of a stratum of non-woven, natural or synthetic fibers bonded together with an adhesive material. Such pads periodically become worn or disformed in use, requiring periodic replacement.

The floor pads for such types of machines are adapted to be secured to the drive shafts of the motors thereof by different means, depending on the particular design of the machine. In some machines such pads are secured to the drive shaft by means of a small, perhaps quarter inch bolt and flat washer with the bolt inserted through the washer and a hole in the center of the pad and threaded into the end of the drive shaft with the head of the bolt bearing on the outer surface of the flat washer to engage and secure the pad between the flat washer and a possible lower flange, shoulder or end portion of the drive shaft. In other known machines provided with a larger and perhaps 3 ½ inch diameter shaft, pads having a larger, comparable center opening are adapted to be mounted on such shafts by receiving the lower end of the shaft through such central opening and securing the pad thereto by means of a clip or similar device.

Because of the different models of floor stripping and burnishing machines having different shaft configurations on which replaceable floor working pads are mounted, it is necessary for manufacturers, distributors and dealers of such mats to provide and maintain an inventory of different floor pad configurations to accommodate such different makes of machines. It thus has been found to be desirable in the manufacture, distribution and use of such floor mats to provide a single floor mat configuration adapted to be used with such different makes of machines having different drive shaft arrangements on which the pads are mounted.

SUMMARY OF THE INVENTION

Accordingly, it is the principal object of the present invention to provide an improved floor pad.

Another object of the present invention is to provide an improved floor pad adapted to be installed on a machine for stripping or burnishing hard floor surfaces.

A further object of the present invention is to provide an improved pad mountable on a machine for stripping or burnishing hard floor surfaces, operating at speeds up to 3,000 rpm.

A still further object of the present invention is to provide an improved floor stripping or burnishing pad which is adapted to be secured on floor working machines having different drive shaft configurations on which such pads are mounted and secured.

Another object of the present invention is to provide an improved floor working pad having universal application on floor working machines of different designs which will reduce the number of such mats required to be manufactured, distributed and inventoried.

A further object of the present invention is to provide an improved floor mat adapted for use with floor working machines of different designs having sufficient shear strength to withstand forces imposed upon operating such pads at speeds of up to 3,000 rpm.

A still further object of the present invention is to provide an improved floor working pad mountable on high speed machines having different drive shaft configurations on which such pads are mounted and secured which is simple in design, easy to manufacture and highly effective in performance.

Other objects and advantages of the present invention will become more apparent to those persons having ordinary skill in the art to which the present invention pertains from the following description taken in conjunction with the accompanying drawings.

BRIEF DESCRIPTION OF THE DRAWINGS

FIG. 1 is a perspective view of an embodiment of the invention;

FIG. 2 is a top plan view of the embodiment shown in FIG. 1; and

FIG. 3 is an enlarged, cross-sectional view taken along line 3—3 in FIG. 2.

DESCRIPTION OF THE PREFERRED EMBODIMENT

Referring to the drawing, there is illustrated an embodiment of the invention consisting of a circular pad 10 adapted to be mounted and secured to a depending shaft portion of a motor of a hard floor surface stripping and burnishing machine. The pad is formed of a stratum of non-woven, air-layered fibers secured together by a binding resin. It is formed with an upper circular surface 11 and a lower, floor engaging surface 12, having a diameter in the range of 5 inch to 40 inch, and an annular side edge 13 providing a thickness in the range of ¼ inch to 2 inch. The center of the pad is provided with an opening 14 which may consist of simply a break in the pad for receiving a small bolt in the order of 1 inch in diameter or a cleanly severed larger opening for receiving an object having a larger shank portion. Disposed concentrically relative to central opening 14 is a plurality of circumferentially spaced, arcuate slits segments 15 extending through the entire thickness of the pad as shown in FIG. 3. Disposed between slit segments 15 are continuous fabric segments 16 which function to connect circular plug portion 17 constituting the pad portion bounded by arcuate slit segments 15, to annular pad portion 18 disposed on the outer side of arcuate slit segments 15.

The composition of the pad is a porous, non-woven, air-layered stratum of synthetic, natural or mineral fibers secured together in random orientations by a binder. The fibers may consist of synthetic materials such as viscose, polyamide, polyester, polyacrilomitrile, acetate polyvinyl, polystyrene and polypropylene materials, or natural fibers including pig bristle and horse hair. The binder may consist of any thermoplastic bonding resin having mechanical and chemical properties compatible with the fibers of the pad such as a phenolic resin, styrene, butodyne, melamine and acrylics. The binder must have chemical affinity with both of the contact surfaces of the random fibers and must provide good adhesion. Its wear resistance should correspond to that of the fibers, and should provide adequate resistance to mechanical wear, chemical deterioration and aging.

The pad as described may be formed by producing a web of porous, non-woven, air-layered of fibers, spraying such web with an uncured, liquid spray of a binding resin so that it penetrates and impregnates the web of fibers, drying the resin impregnated in the web and allowing the resin to cure and finally cutting the web to form the center opening 14, the slit segments 15 and the outer perimeter of the pad.

In the installation of the pad as described in a machine of the type utilizing a bolt and flat washer for securing the pad to the lower end of the drive shaft of the machine, the flat washer may first be placed on the threaded bolt, the bolt with the washer thereon may then be inserted through opening 14 and the bolt thus inserted through the pad may be threaded into the lower end of the drive shaft to secure the pad between the flat washer on the bolt and a flanged portion of the drive shaft as the head of the bolt engages and bears on the washer. In the installation of the pad on a machine having a larger cylindrical surface on which the pad is mounted and secured by a clip device, the center of the pad is punctured to sever the pad along connecting segments 16 and thus remove portion 17, portion 18 is mounted on the drive shaft so that the lower end of the drive shaft is received through the opening formed by the removal of plug portion 17 and then the clipping device is attached to secure the pad to the drive shaft of the machine.

In the design of the pad, the number and lengths of arcuate slit segments 15 are selected so that connecting segments 16 of the pad will have a sufficient shear strength to withstand the forces of the connected drive shaft operating at speeds up to 3,000 when plug portion 17 of the pad is intact and the pad is connected to the drive shaft of the machine by means of a bolt inserted through opening 14. The strength provided by such connecting portions should be sufficient to withstand the operational forces developed when the pad is secured to a drive shaft by means of a narrow bolt inserted through opening 14 yet insufficient to resist the manual or mechanical puncturing of plug portion 17 when desired to install the pad on a machine having a drive shaft adapted to be received through the opening formed by the removal of the plug portion of the pad.

Although the embodiment as described provides for only a single set of circumferentially spaced, arcuate slit segments 15 disposed concentrically to center opening 14, it is contemplated within the scope of the invention that one or more additional sets of such slots disposed concentrically with the center opening may be provided to accommodate a greater number of drive shaft arrangements. In providing such additional sets of arcuate slit segments of increased diameter, additional care must be taken in the design of such embodiments to avoid sufficiently weakened connecting segments which would result in the outer portion 18 of the pad shearing off when the pad is used in an application with the pad being secured to the drive shaft of the machine by means of a flat washer and a bolt extending through center opening 14.

It further is contemplated within the scope of the invention that segments 15 which accommodate the puncturing of the center of the pad and the removal of plug portion 17 not be severed entirely through the pad thickness but be only sufficiently weakened to permit the puncturing of the center portion of the pad for the removal of plug portion 17. Providing such a weakened construction in lieu of a thoroughly severed construction further would enhance the ability of the pad to withstand the shearing forces on the pad tending to shear off outer portion 18 when the pad is installed on a machine by means of a flat washer and a narrow bolt inserted through center opening 14.

With the type of fastening arrangement as described, it will be appreciated that a single type of pad may be manufactured, distributed and inventoried which is capable of being used with at least two different types of machines and possibly more which provides a much more cost effective product.

From the foregoing detailed description, it will be evident that there are a number of changes, adaptations and modifications of the present invention which come within the province of those having ordinary skill in the art to which the aforementioned invention pertains. However, it is intended that all such variations not departing from the spirit of the invention be considered as within the scope thereof as limited solely by the appended claims.

I claim:

1. A pad mountable either on an end or side portion of a drive shaft of a floor working machine comprising:

At least one stratum of a porous, non-woven, air-layered fibrous material secured together with an adhesive binder, said stratum having a first opening therethrough for receiving a fastening means therethrough and at least one set of a plurality of circumferentially spaced, arcuate weakened segments, disposed concentrically relative to said first opening, providing a plurality of unweakened segments disposed between said weakened segments, whereby said pad selectively may be mounted on an end portion of a drive shaft of a machine by means of a fastening device being inserted through said first opening, and said pad alternatively may be mounted on a side portion of a drive shaft by severing said pad along said weakened and unweakened segments to provide an opening for receiving a drive shaft therethrough and securing said pad thereto.

2. A pad according to claim 1 wherein said unweakened segments of said pad have sufficient shear strength to withstand the forces imposed upon operating said pads at high speeds, yet insufficient shear strength to resist severance thereof in forming an opening for receiving a drive shaft therethrough.

3. A pad according to claim 1 wherein said unweakened segments of said pad have sufficient sheer strength to withstand the forces imposed upon operating such pads at speeds of up to 3,000 rpm.

4. A pad according to claim 1 wherein said pad is formed of natural fibers.

5. A pad according to claim 1 wherein said pad is formed of synthetic fibers.

6. A pad according to claim 1 wherein said pad is formed of synthetic fibers selected from a group of materials consisting of viscose, polyamide, polyester, polyacrilomitrile, acetate polyvinyl, polystyrene and polypropylene.

7. A pad according to claim 1 wherein said binder material consists of a resin selected from a group consisting of a phenolic resin, styrene, butodyne, melomine and acrylics.

8. A pad according to claim 1 wherein said weakened segments comprise slits extending through said pad.

9. A pad according to claim 8 wherein said unweakened segments comprise undisturbed portions of said stratum of porous, non-woven, air-layered fibers impregnated with said binder.

10. A pad according to claim 8 wherein said unweakened segments have a shear strength sufficient to withstand the forces imposed upon mounting said pad on said end portion of a drive shaft with a fastening means inserted through said first opening, and insufficient to prevent a puncturing of said pad to form said second opening.

11. A pad according to claim 10 wherein said shear strength is sufficient to withstand machine speeds of up to 3,000 rpm and insufficient to withstand a manual puncturing of said pad to form said second opening.

12. A pad according to claim 1 wherein said pad has a disc configuration.

* * * * *